US008237762B2

(12) United States Patent
Ugajin et al.

(10) Patent No.: US 8,237,762 B2
(45) Date of Patent: Aug. 7, 2012

(54) EXPOSURE DEVICE FOR CONTROLLING LIGHT EMITTING ELEMENTS

(75) Inventors: Atsushi Ugajin, Kanagawa (JP); Satoshi Kurashima, Kanagawa (JP); Kohei Shioya, Kanagawa (JP); Tetsuya Hori, Kanagawa (JP); Tomoaki Sakita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 362 days.

(21) Appl. No.: 12/569,933

(22) Filed: Sep. 30, 2009

(65) Prior Publication Data

US 2010/0208025 A1 Aug. 19, 2010

(30) Foreign Application Priority Data

Feb. 13, 2009 (JP) ..... 2009-030591

(51) Int. Cl.
*B41J 2/435* (2006.01)

(52) U.S. Cl. ..... 347/247; 347/224

(58) Field of Classification Search ..... 347/247, 347/224; 372/38.02, 38.07
See application file for complete search history.

(56) References Cited

U.S. PATENT DOCUMENTS

2006/0023761 A1* 2/2006 Moriyama ..... 372/38.02
2008/0056318 A1* 3/2008 Kubo ..... 372/38.07

FOREIGN PATENT DOCUMENTS

JP 2004-071974 A 3/2004
JP 2004-288801 A 10/2004
JP 2005-070067 A 3/2005

* cited by examiner

*Primary Examiner* — Stephen Meier
*Assistant Examiner* — Carlos A Martinez
(74) *Attorney, Agent, or Firm* — Sughrue Mion, PLLC

(57) ABSTRACT

An exposure device includes a reference current generating unit generating a reference current for each image of respective colors, a photoelectric current generating unit generating a photoelectric current in response to a light amount of the light emitting element, a driving unit driving the light emitting element, a first controller, a drive voltage holding unit holding a drive voltage given to the driving unit, a second controller controlling the driving unit based on the drive voltage held, a comparison current generating unit generates a comparison current, a difference current generating unit generating a difference current, of each color, corresponding to a difference between the reference current of each color and the comparison current. The first controller compares a value obtained by adding the difference current of each color to the photoelectric current with the comparison current to control the driving unit so that the photoelectric current becomes the reference current.

7 Claims, 8 Drawing Sheets

EXPOSURE DEVICE FOR CONTROLLING LIGHT EMITTING ELEMENTS

CROSS-REFERENCE TO RELATED APPLICATIONS

This application is based on and claims priority under 35 USC 119 from Japanese Patent Application No. 2009-30591 filed Feb. 13, 2009.

BACKGROUND

Technical Field

The present invention relates to an exposure device, an image forming apparatus and a computer-readable medium storing a program that causes a computer to execute an exposure control process.

SUMMARY

According to an aspect of the invention, an exposure device includes a light emitting element, a reference current generating unit, a photoelectric current generating unit, a driving unit, a first controller, a drive voltage holding unit, a second controller, a comparison current generating unit and a difference current generating unit. The reference current generating unit generates a reference current which gives a target value of a light amount of the light emitting element, for each image of respective colors formed by exposure using the light emitting element. The photoelectric current generating unit generates a photoelectric current in response to the light amount of the light emitting element. The driving unit drives the light emitting element. The first controller controls the driving unit so that the photoelectric current becomes equal to the reference current. The drive voltage holding unit holds a drive voltage which is given to the driving unit by the first controller. The second controller controls the driving unit based on the drive voltage held by the drive voltage holding unit to carry out the exposure by the light emission of the light emitting element. The comparison current generating unit generates a certain comparison current. The difference current generating unit generates a difference current, of each color, having a value corresponding to a difference between the reference current of each color and the comparison current. The first controller compares a value obtained by adding the difference current of each color to the photoelectric current with the comparison current to control the driving unit so that the photoelectric current becomes equal to the reference current.

BRIEF DESCRIPTION OF THE DRAWINGS

Exemplary embodiments of the invention will be described below in detail based on the accompanying drawings, wherein.

DETAILED DESCRIPTION

Hereinafter, exemplary embodiments of the present invention will be described.

Figure 1:
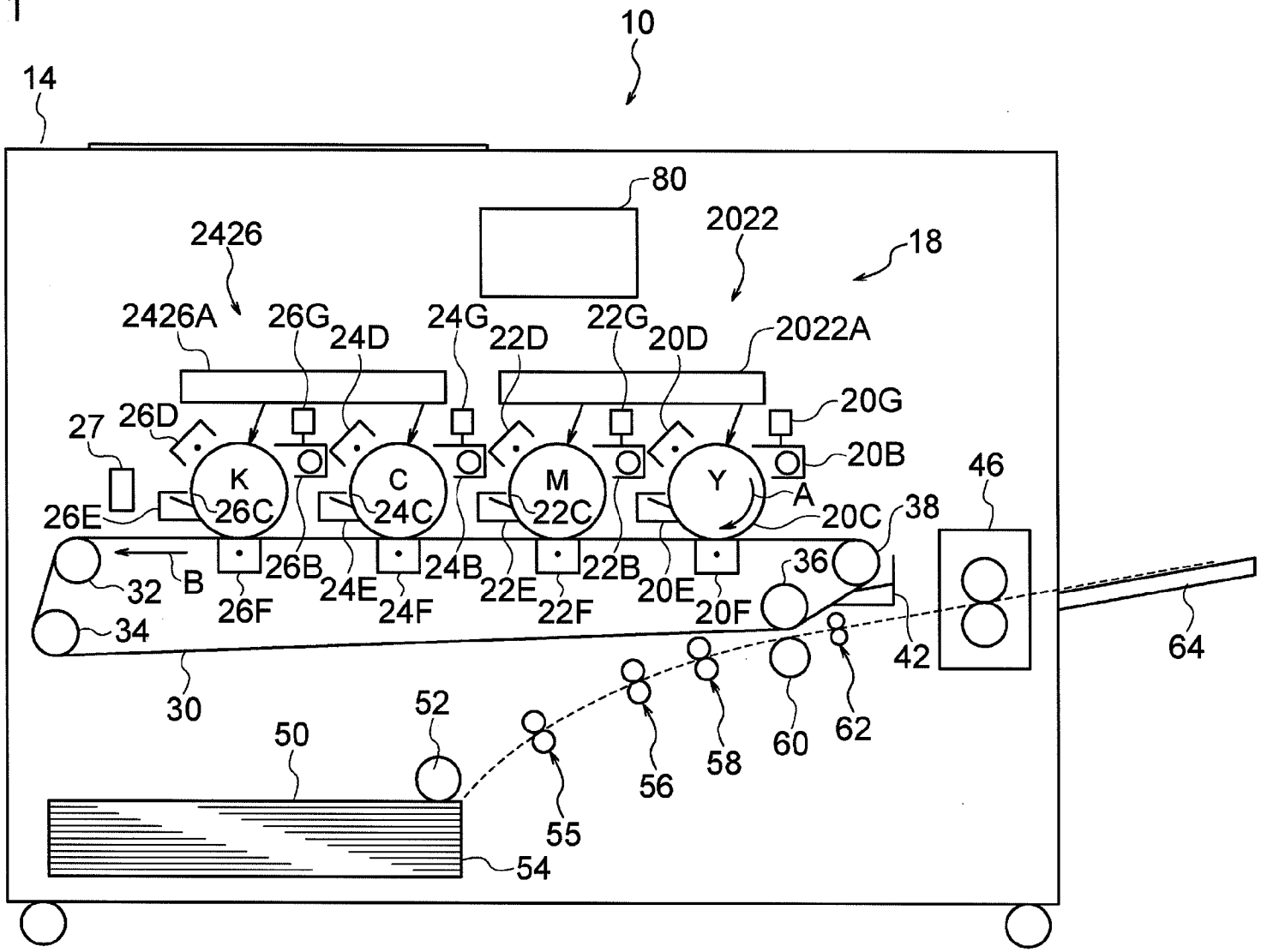
FIG. 1 is a schematic view showing the entire configuration of an image forming apparatus according to one exemplary embodiment of the present invention.

FIG. 1 is a schematic view showing the entire configuration of an image forming apparatus 10 according to this exemplary embodiment.

The image forming apparatus 10 is covered by a casing 14. The image forming apparatus 10 includes an image forming section 18 and an image processing control section 80 in the interior of the casing 14. The image forming section 18 forms color images on sheets. The image processing control section 80 controls the entirety of image processing in the image forming section 18.

The image forming section 18 includes an intermediate transfer body 30, a YM image forming unit 2022, a CK image forming unit 2426, a sheet conveyance path, conveyance rollers and a fixing device 46. The intermediate transfer body 30 serves as a recording medium that conveys, in a conveyance direction indicated by an arrow B in FIG. 1, a developing material which forms an image and which electrostatically absorbs thereto. The intermediate transfer body 30 is a belt structure which travels around with being wound on rollers 32, 34, 36 and 38. The YM image forming unit 2022 forms a Y (yellow) color image and a M (magenta) color image. The CK image forming unit 2426 forms a C (cyan) color image and a K (black) color image. The YM image forming unit 2022 and the CK image forming unit 2426 are disposed in a tandem manner from the upstream side toward the downstream side along a conveyance direction (the direction of the arrow B shown in FIG. 1) of the intermediate transfer body 30. The sheet conveyance path and conveyance rollers are configured to feed out a sheet 50 from a sheet accommodation section 54 and to convey the same. The fixing device 46 performs a fixing process for the sheet onto which a toner image is transferred. Also, the image forming section 18 includes a detection section 27, serving as position detecting unit, on the downstream side of the CK image forming unit 2426 in the conveyance direction (the direction of the arrow B in FIG. 1).

The YM image forming unit 2022 is provided with an optical beam scanning device 2022A that is an exposure device common to Y and M colors. The optical beam scanning device 2022A emits Y-color laser light and M-color laser light which are modulated based on image data.

For the Y color, the YM image forming unit 2022 includes a photosensitive drum 20C, a charging device 20D, a developing device 20B, a toner feeding part 20G, a transfer device 20F and a cleaning device 20E. The charging device 20D charges the photosensitive drum 20C at a predetermined potential. The developing device 20B develops a latent image formed by Y-color laser light output from the optical beam scanning device 2022A. The toner feeding part 20G feeds a Y-color toner to the developing device 20B. The transfer device 20F transfers a yellow toner image from the photosensitive drum 20C onto the intermediate transfer body 30. The cleaning device 20E removes toner from the outer circumferential surface of the photosensitive drum 20C.

For the M color, the YM image forming unit 2022 includes a photosensitive drum 22C, a charging device 22D, a developing device 22B, a toner feeding part 22G, a transfer device 22F and a cleaning device 22E.

The CK image forming unit 2426 includes an optical beam scanning device 2426A serving as an exposure device common to C and K colors. The optical beam scanning device 2426A emits C-color laser light and K-color laser light, which are modulated based on image data.

For the C color, the CK image forming unit 2426 includes a photosensitive drum 24C, a charging device 24D, a developing device 24B, a toner feeding part 24G, a transfer device 24F and a cleaning device 24E. The charging device 24D charges the photosensitive drum 24C at a predetermined potential. The developing device 24B develops a latent image formed by C-color laser light output by an optical beam scanning device 2426A. The toner feeding part 24G feeds a C-color toner to the developing device 24B. The transfer device 24F transfers a C-color toner image from the photosensitive drum 24C onto the intermediate transfer body 30. The cleaning device 24E removes toner from the outer circumferential surface of the photosensitive drum 24C.

For the K color, the CK image forming unit 2426 includes a photosensitive drum 26C, a charging device 26D, a developing device 26B, a toner feeding part 26G, a transfer device 26F and a cleaning device 26E.

Scanning exposure of optical beams from the optical beam scanning device 2022A and the optical beam scanning device 2426A to the photosensitive drum 20C, the photosensitive drum 22C, the photosensitive drum 24C and the photosensitive drum 26C is carried out at predetermined intervals that are determined by a conveyance speed of the intermediate transfer body 30 and distances between the photosensitive drum 20C, the photosensitive drum 22C, the photosensitive drum 24C, and the photosensitive drum 26C.

As shown in FIG. 1, a sheet accommodation section 54 that accommodates sheets 50 is provided below the intermediate transfer body 30. An uppermost sheet 50 of the sheet accommodation section 54 is fed out to a sheet conveyance path by means of a feed-out roller 52. A fed-out sheet 50 is conveyed through the sheet conveyance path by the conveyance roller 55, a conveyance roller 56 and a conveyance roller 58, and reaches the vicinity of the intermediate transfer body 30.

A conveyance roller 60 that faces the conveyance roller 36 across the intermediate transfer body 30 is provided on the sheet conveyance path. A color image that is formed by superimposing toner images of the respective colors on the intermediate transfer body 30 is transferred onto the sheet 50 when the sheet 50 is conveyed through the facing part between the conveyance roller 36 (in fact, the intermediate transfer body 30) and conveyance roller 60.

The sheet 50 having the color image transferred thereon is conveyed to the fixing device 46 by a conveyance roller 62. After the sheet 50 is subjected to the fixing process (heated and pressurized) by the fixing device 46, the sheet 50 is ejected to a sheet tray 64.

Figure 2:
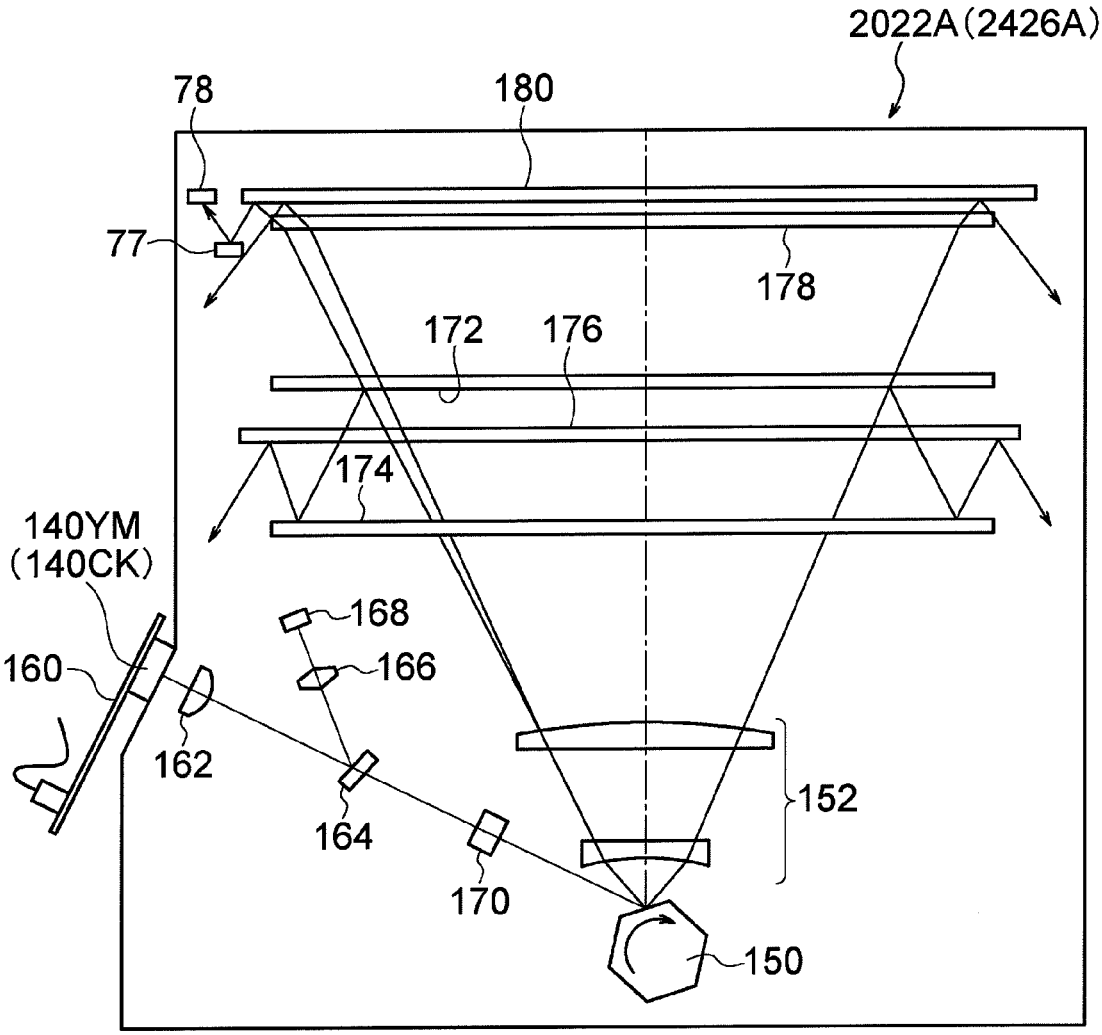
FIG. 2 is a view for explaining the configuration of an optical system of an optical beam scanning device in the image forming apparatus according to the one exemplary embodiment of the present invention.
Figure 3:
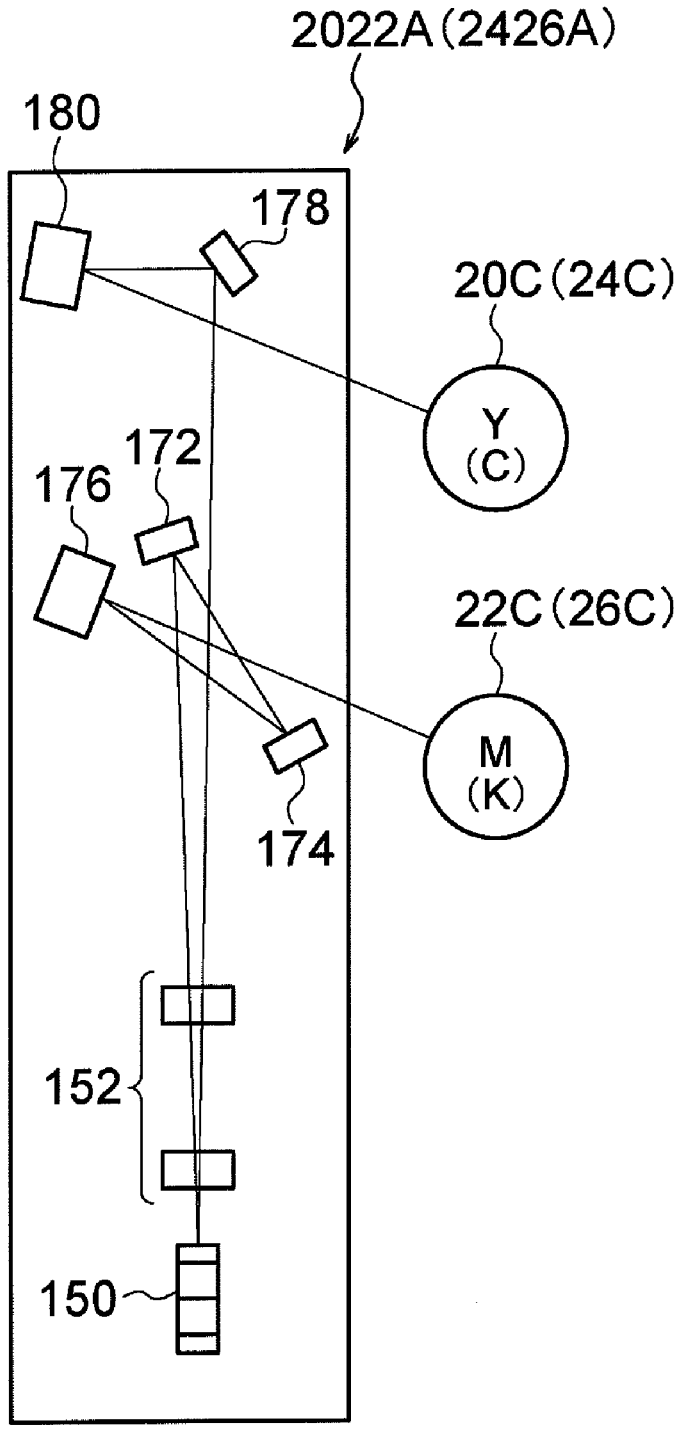
FIG. 3 is a view for explaining the configuration of the optical system of the optical beam scanning device in the image forming apparatus according to the one exemplary embodiment of the present invention.

FIG. 2 and FIG. 3 are views for explaining the configuration of an optical system of the optical beam scanning device 2022A.

The optical beam scanning device 2022A (the optical beam scanning device 2426A has a similar structure) has an optical system that causes plural optical beams simultaneously to be incident into a single rotary polygon mirror unit 150 and guides the optical beams, which have passed through an fθ lens 152, to the photosensitive drum 20C for Y color and the photosensitive drum 22C for M color (or the photosensitive drum 24C for C color and the photosensitive drum 26C for K color) which are shown in FIG. 3.

The rotary polygon mirror unit 150 is an assembly composed of a polygon mirror having planar mirror surfaces on its circumference and a motor coupled with the rotation axis of the polygon mirror to rotate the polygon mirror at a high speed.

The optical beam scanning device 2022A of FIG. 2 corresponds to image data of yellow (Y) and magenta (M) colors. Also, the optical beam scanning device 2426A corresponds to image data of cyan (C) and black (K) colors.

A light source (laser light-emitting arrays) 140YM (140CK) attached to a circuit substrate 160A has plural (e.g., thirty two) light emitting elements (details of which will be described later). As shown in FIG. 2, optical beams are emitted from the plural light emitting elements of the light source 140YM (140CK), pass through a collimator lens 162 and are separated into reflection light and transmission light by a half mirror 164.

The reflection light is input into a photo detector 168 via a lens 166, and is adjusted to a predetermined light amount in a light amount control (APC: Auto Power Control) which will be described in detail later.

Also, the transmission light, which passes through the half mirror 164, is incident into the rotary polygon mirror unit 150 via a cylindrical lens 170, and reflection light thereof (scanning light) passes through the fθ lens 152.

Here, a part of the optical beam passing through the fθ lens 152 is incident into a cylindrical mirror for M (the cylindrical mirror for K) 176 via reflection mirrors 172 and 174, and is guided to the photosensitive drum 22C (1026C).

Also, another part of the optical beam passing through the fθ lens 152 is incident into a cylindrical mirror for Y (the cylindrical mirror for C) 1180 via a reflection mirror 178, and is guided to the photosensitive drum 20C (24C).

At this time, the optical system is configured so that an optical beam of any one of the colors is incident into an SOS (Start of Scan) sensor 78 via a reflection mirror 77.

The laser light-emitting arrays 140YM and 140CK (hereinafter, which may be collectively referred to as a "laser light-emitting array 140") are configured so that light emitting elements 2 serving as laser light sources are arranged in an array manner with plural light emitting elements being disposed in a main-scanning direction and with plural light emitting elements being disposed in a sub-scanning direction. The light emitting elements 2 are vertical cavity surface emitting laser diodes for forming latent images on the surfaces of the photosensitive drums 20C, 22C, 24C, 26C (hereinafter which may be referred to as a "photosensitive drum 20C" representing the respective photosensitive drums).

Hereinafter, a control system for controlling amounts of light emitted from the light emitting elements will be described in detail.

Figure 4:
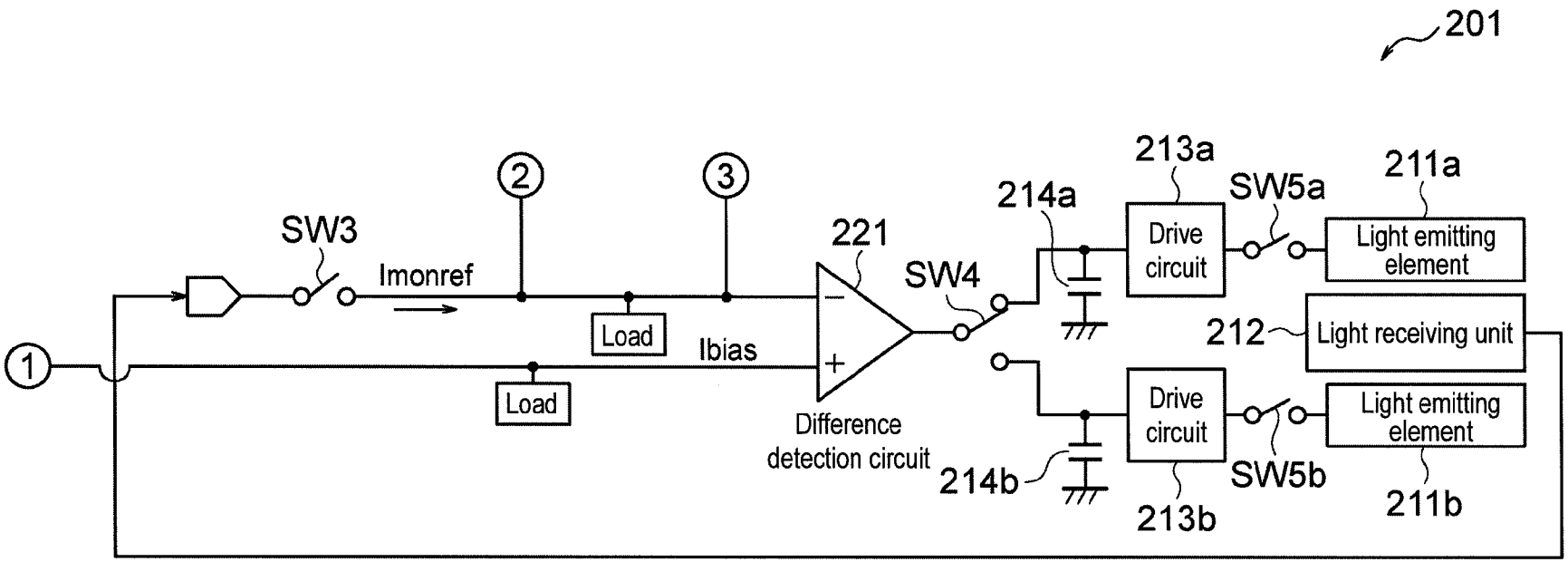
FIG. 4 is a circuit diagram showing the entire configuration of a light emitting element drive unit in the image forming apparatus according to the one exemplary embodiment of the present invention.
Figure 5:
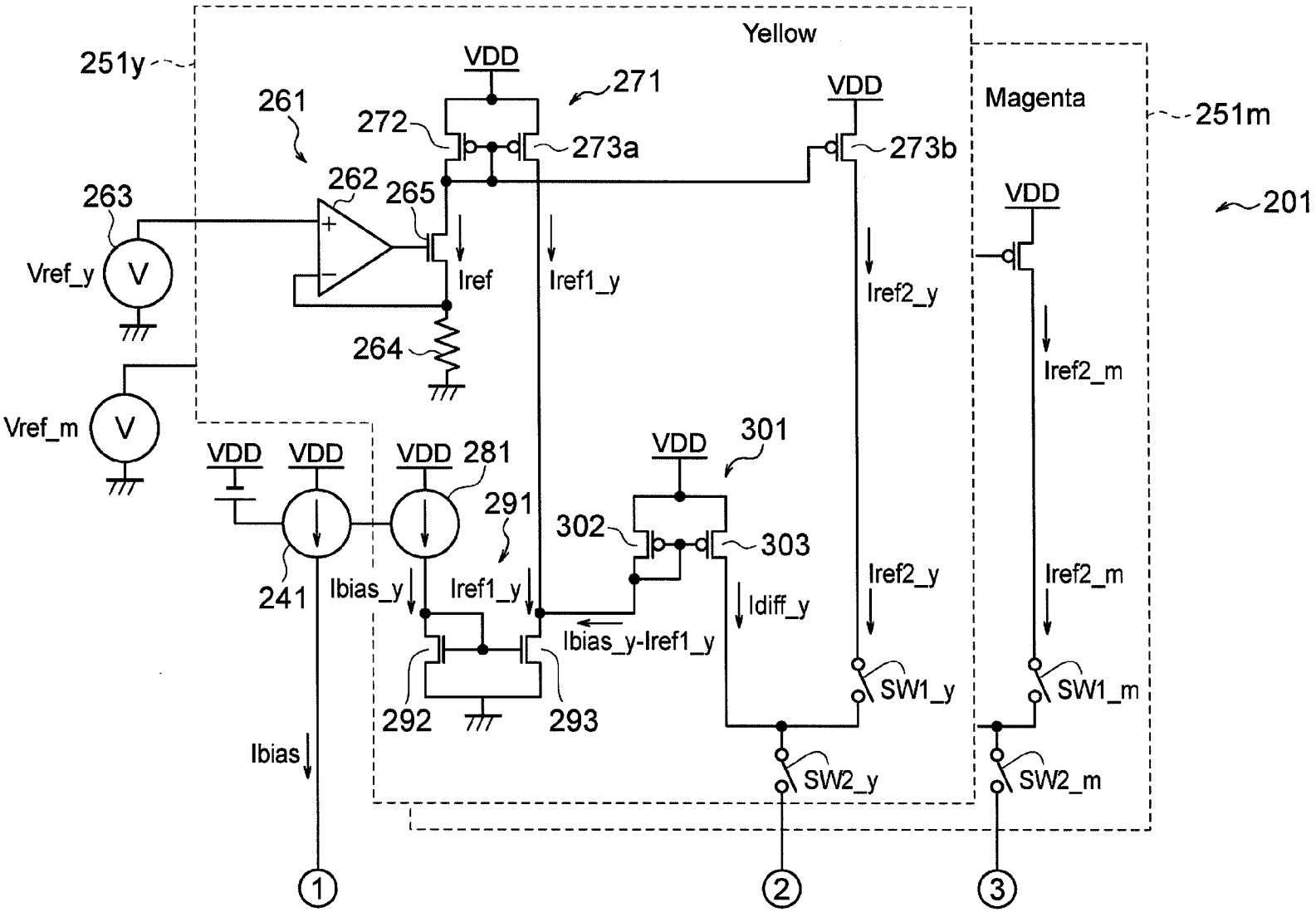
FIG. 5 is a circuit diagram showing the entire configuration of the light emitting element drive unit in the image forming apparatus according to the one exemplary embodiment of the present invention.

FIG. 4 and FIG. 5 are circuit diagrams showing the entire configuration of a light emitting element drive unit 201 that controls the amounts of light emitted from the light emitting elements.

The light emitting element drive unit 201 is shown as a light emitting element drive unit 201 that is provided in the optical beam scanning unit 2022A, which is the exposure device common to Y color and M color of the YM image forming unit 2022. A light emitting element drive unit 201 of the optical beam scanning unit 2426A serving as an exposure device common to C color and K color of the CK image forming unit 2426 also has a similar circuit configuration thereto. Therefore, description will be given on the light emitting element drive unit 201 of the optical beam scanning unit 2022A as a representative.

For the sake of simplicity, this example shows the case in which two light emitting elements 211*a* and 211*b* are driven and controlled. However, the configuration is not limited to the above-described example in which two light emitting elements 211*a* and 211*b* are driven. It is a matter of course that such a configuration in which a single light emitting element or three or more light emitting elements are driven may be adopted. This example shows the configuration of the circuit system of the light amount controlling circuit for carrying out the feedback control for the amounts of light emitted from the light emitting elements 211*a* and 211*b* to be a target light amount.

A light receiving unit 212 (e.g., the photo detector 168) is formed of, for example, a photodiode. The light receiving unit 212 receives optical beams emitted from the light emitting elements 211*a* and 211*b*, and outputs a photoelectric current in response to the amount of received light.

A difference detection circuit 221 is formed of, for example, an operational amplifier. The light receiving unit 212 outputs the photoelectric current Imonref to an inverting (−) input terminal of the difference detection circuit 221. A predetermined voltage is supplied into a non-inverting (+) input terminal of the difference detection circuit 221. The difference detection circuit 221 supplies a voltage in accordance with a difference between the photoelectric current Imonref and the predetermined voltage.

A drive circuit 213*a* drives the light emitting element 211*a*, and a drive circuit 213*b* drives the light emitting element 211*b*. The output of the difference detection circuit 221 is selectively given to either the drive circuit 213*a* or 213*b* by changing a switch SW4.

One end of a sample-hold circuit 214*a* is connected to a line connecting the output terminal of the difference detection circuit 221 to the drive circuit 213*a*, and the other end of the sample-hold circuit 214*a* is connected to the ground GND. The sample-hold circuit 214*a* samples and holds a value of a voltage given from the difference detection circuit 221 to the drive circuit 213*a*. One end of a sample-hold circuit 214*b* is connected to a line connecting the output terminal of the difference detection circuit 221 to the drive circuit 213*b*, and the other end of the sample-hold circuit 214*b* is connected to the ground GND. The sample-hold circuit 214*b* samples and holds the value of the voltage given from the difference detection circuit 221 to the drive circuit 213*b* as a sample.

In such a circuit configuration, the difference detection circuit 221 carries out the feedback control for the light amounts of the light emitting elements 211*a* and 211*b*, which are received by the light receiving unit 212, to be a target light amount. That is, if a reference current corresponding to the target light amount is given to the non-inverting (+) input terminal of the difference detection circuit 221, the light emitting elements 211*a* and 211*b* can be controlled so as to be the light amount corresponding to the reference current.

In order to expose the photosensitive drum 20C (hereinafter, a representative of the photosensitive drums of the respective colors Y, M, C and K may be referred to as the "photosensitive drum 20C") with light emitted from the light emitting elements 211*a* and 211*b*, an operation referred to as the "Auto Power Control" (APC) is carried out so that errors in the light emitting elements 211*a* and 211*b* don't cause unevenness in colors.

That is, the reference current corresponding to the target light amount is given to the non-inverting (+) input terminal of the difference detection circuit 221, and the sample-hold circuit 214*a* or 214*b* is caused to sample and hold the output voltage of the difference detection circuit 221 when the output of the difference detection circuit 221 becomes stable. When the light emitting elements 211*a* and 211*b* are caused to emit light in order to expose the photosensitive drum 20C, the drive circuits 213*a* and 213*b* cause the light emitting elements 211*a* and 211*b* to emit light using the voltages, which are sampled and held in the sample-hold circuit 214*a* or 214*b*, as the drive voltages. Therefore, the light emitting elements 211*a* and 211*b* are caused to emit light with the light amounts of the light emitting elements 211*a* and 211*b* being controlled to the target light amount.

In this exemplary embodiment, the optical beam scanning unit 2022A of the YM image forming unit 2022 serves as the exposure device common to Y color and M color. The above-described feedback control system having the difference detection circuit 221 and the light receiving unit 212, etc., uses a common circuit. That is, the above-described feedback control system is commonly used in formation of a Y-color latent image and formation of a M-color latent image.

Here, optical energies given to the photosensitive drums vary depending upon the colors Y, M, C and K. Therefore, in the optical beam scanning unit 2022A, the values of the reference voltages given to the non-inverting (+) input terminal of the difference detection circuit 221 vary from the case where a Y-color latent image is formed to the case where an M-color latent image is formed. Therefore, the convergence property of the above-described APC operation may be deteriorated due to potential fluctuation occurring in the light emitting elements 211*a* and 211*b*. There is a concern that a time for a potential output by the difference detection circuit 221 in the APC to become stable may be long.

Then, in this exemplary embodiment, a circuit described below is provided.

First, a current source 241 generates a comparison current Ibias, which is a constant current, from a power source voltage VDD. The comparison current Ibias has a constant value regardless of formation of a Y-color latent image and formation of an M-color latent image. The comparison current Ibias is given to the non-inverting (+) input terminal of the difference detection circuit 221.

Also, the light emitting element drive unit 201 is provided with a Y-color difference current generation circuit 251*y* and an M-color difference current generation circuit 251*m*. The Y-color difference current generation circuit 251*y* is a circuit that generates a current which is to be added to the photoelectric current Imonref and given to the inverting (−) input terminal of the difference detection circuit 221 when a Y-color latent image is formed. The M-color difference current generation circuit 251*m* is a circuit that generates a current which is to be added to the photoelectric current Imonref and given to the inverting (−) input terminal of the difference detection circuit 221 when an M-color latent image is formed. Since the Y-color difference current generation circuit 251*y* and the M-color difference current generation circuit 251*m* have the same circuit configuration, description will be given only on the Y-color difference current generation circuit 251*y* as a representative of them.

A constant current circuit 261 is provided with an operational amplifier 262, a constant voltage source 263 and a reference resistance 264. The constant voltage source 263 inputs a variable comparison voltage $Vref_y$ to a non-inverting input terminal of the operational amplifier 262. The comparison resistance 264 has a resistance value $Rref_y$. One end of the comparison resistance 264 is connected to an inverting input terminal of the operational amplifier 262, and the other end of the comparison resistance 264 is connected to the ground GND. An output terminal of the operational amplifier 262 is connected to a gate of an NMOS 265, and a drain of the NMOS 265 is connected to one end of the comparison resistance 264 and the inverting input terminal of the operational amplifier 262. The constant current circuit 261 generates a reference current Iref in accordance with Iref=Vref/Rref.

A current mirror circuit 271 is configured so that a gate of a PMOS 272 is connected to gates of two PMOSs 273*a* and 273*b*, and that the respective gates are connected to a drain of the PMOS 272. The drain of the PMOS 272 is connected to the drain of the NMOS 265. The power source voltage VDD is input to sources of the respective PMOS 272, 273*a* and 273*b*. Also, the PMOS 272, 273*a*, 273*b* are formed of PMOS which are equal in W/L size to each other. Since all the gate voltages of the respective PMOS 273*a* and 273*b* are equal to each other, reference currents $Iref1_y$ and $Iref2_y$ are equal in current value to the reference current Iref and are output from the drain of the respective PMOS 273*a* and 273*b*, respectively.

A current source 281 generates a comparison current $Ibias_y$, which is a current equal to the comparison current Ibias, from the power source voltage VDD.

A current mirror circuit 291 is configured so that a gate of an NMOS 292 is connected to a gate of an NMOS 293 and that the respective gates are connected to a drain of the NMOS 292. The comparison current $Ibias_y$ is supplied from the drain side of the NMOS 292 by the constant current circuit 281, and the sources of the NMOS 292 and 293 are connected to the ground GND. The current mirror circuit 291 outputs the comparison current $Ibias_y$ from an output side thereof, using the comparison current $Ibias_y$ as an input current.

A current mirror circuit 301 is configured so that a gate of a PMOS 302 is connected to a gate of a PMOS 303, and the respective gates are connected to a drain of the PMOS 302. The drain of the PMOS 302 is connected to the drain of the NMOS 293, and the drain of the PMOS 273*a* is connected to the drain of the NMOS 293. The reference current $Iref1_y$ flows into the drain of the NMOS 293, and the output current of the current mirror circuit 291 is the comparison current $Ibias_y$. Therefore, an input current of the current mirror circuit 301 becomes "$Ibias_y$−$Iref1_y$." The output current of the current mirror circuit 301 becomes "$Ibias_y$−$Iref1_y$", and will be referred to as a "difference current $Idiff_y$".

A drain of the PMOS 303 is connected to the inverting (−) input terminal of the difference detection circuit 221 via a switch $SW2_y$. When the switch $SW2_y$ is closed, a current obtained by adding the difference current $Idiff_y$ to the photoelectric current Imonref is supplied to the inverting (−) input terminal of the difference detection circuit 221.

Also, the drain of the PMOS 273*b* is connected to the inverting (−) input terminal of the difference detection circuit 221 via the switch $SW2_y$ and a switch $SW1_y$. When the switches $SW2_y$ and $SW1_y$ are closed, a current obtained by adding the difference current $Idiff_y$ and the reference current $Iref2_y$ to the photoelectric current Imonref is supplied to the inverting (−) input terminal of the difference detection circuit 221.

As described above, the Y-color difference current generation circuit 251*y* and the M-color difference current generation circuit 251*m* have the same circuit configuration. and a difference current $Idiff_m$ of the M-color difference current generation circuit 251*m* corresponds to the difference current $Idiff_y$ output by the Y-color difference current generation circuit 251*y*, and a reference current $Iref2_m$ of the M-color difference current generation circuit 251*m* corresponds to the reference current $Iref2_y$ output by the Y-color difference current generation circuit 251*y*.

Figure 6:
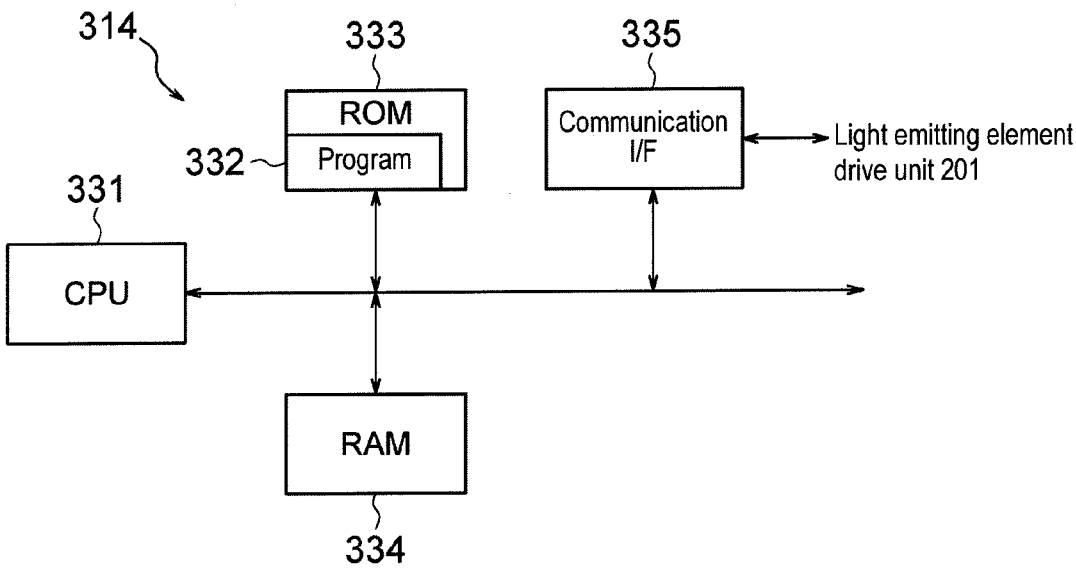
FIG. 6 is a block diagram showing electrical connections of a control section for controlling a YM image forming unit and a CK image forming unit in the image forming apparatus according to the one exemplary embodiment of the present invention.

FIG. 6 is a block diagram showing electrical connections of a control section 314 that controls the YM image forming unit 2022 and the CK image forming unit 2426.

The control section 314 is, for example, a microcomputer. The control section 314 is provided with a CPU 331 for collectively controlling respective parts. A ROM 331, a RAM 334 and a communication interface (I/F) 335 are connected to the CPU 331. The ROM 333 stores various types of control programs executed by the CPU 331 and fixed data. The RAM 334 serves as a working area of the CPU 331. The communications interface 335 communicates with the light emitting element drive unit 201.

The control program 332 may be installed in the process of manufacturing the image forming apparatus 10. Instead, the control program 332 may be read later from a computer readable medium (e.g., CD-ROM, DVD-ROM or the like) storing the control program 332, and be installed in a non-volatile memory or a magnetic memory of the control section 314. Further alternatively, the control program 332 may be downloaded in the form of carrier waves from a communication line such as the Internet and be installed in the non-volatile memory or the magnetic memory of the control section 314.

Next, description will be given on an operation of the circuits shown in FIGS. 4 to 6 using as an example in which a Y-color image is formed.

Figure 7:
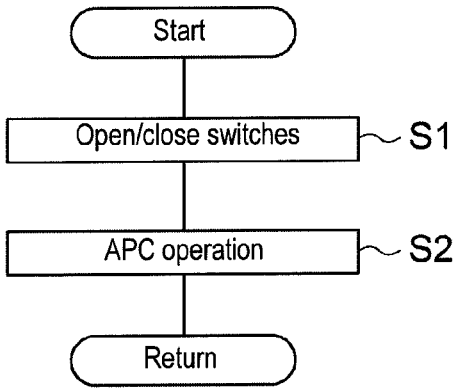
FIG. 7 is a flowchart when an APC operation is carried out in the image forming apparatus according to the one exemplary embodiment of the present invention.

FIG. 7 is a flowchart when an APC operation is carried out in the above-described circuits.

When the APC operation is to be carried out, the control section 314 opens the switch $SW1_y$, closes the switches $SW2_y$, closes the switch SW3, changes the switch SW4 so that the difference detection circuit 221 is connected to the sample-hold circuit 214*a* and the drive circuit 213*a*, and closes the switch SW5 (Step S1). Then, the APC operation described above is executed (Step S2)

As described above, $$\text{Comparison current } Ibias_y - \text{Reference current } Iref1_y (= Iref_y = Iref2_y) = \text{Difference current } Idiff_y$$

Therefore, the following expression can be obtained.

$$\text{Comparison current } Ibias_y = \text{Reference current } Iref1_y (= Iref_y = Iref2_y) + \text{Difference current } Idiff_y$$

Figure 8:
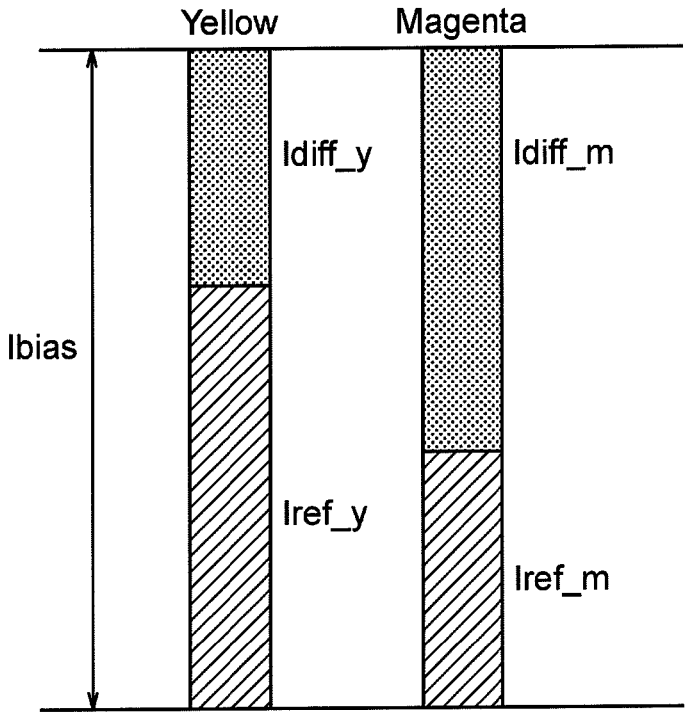
FIG. 8 is a graph for explaining an operation of the light emitting element drive unit in the image forming apparatus according to the one exemplary embodiment of the present invention.

The value of the comparison current Ibias when a Y-color latent image is formed is equal to the value of the comparison current Ibias when an M-color latent image is formed, and the values of the comparison currents Ibias are shown in FIG. 8. As described above, the light-emitting power of the light emitting elements 211*a* and 211*b* very from the case where the Y-color latent image is formed to the case where the M-color latent image is formed. Therefore, the value of the reference current $Iref1_y$ is different from that of the reference current $Iref1_m$. The values of the difference current $Idiff_y$ and the difference current $Idiff_m$, are also accordingly different from each other.

Figure 9:
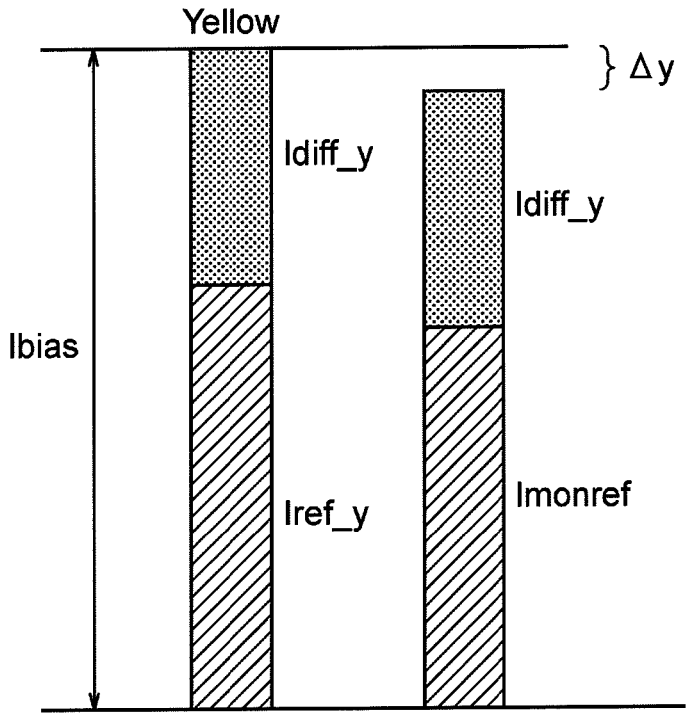
FIG. 9 is a flowchart when the APC operation is carried out in the image forming apparatus according to the one exemplary embodiment of the present invention.

There is a difference equivalent to Δy between the reference current $Iref1_y$ and the photoelectric current Imonref. Therefore, there is a difference equivalent to Δy between (i) a current value obtained by adding the difference current $Idiff_y$ to the photoelectric current Imonref and (ii) the comparison current $Ibias_y$ as shown in FIG. 9. Therefore, when the APC operation is carried out, the feedback control is carried out in the difference detection circuit 221 so as to cancel this difference Δy.

Thus, in comparison with the case where the reference current $Iref1_y$ when a Y-color image is formed or the reference current $Iref1_m$ when an M-color image is formed is supplied to the non-inverting (+) input terminal of the difference detection circuit 221 and is directly compared with the photoelectric current Imonref, the current supplied to the non-inverting (+) input terminal of the difference detection circuit 221 less varies from the case where a Y-color latent image is formed to the case where an M-color latent image.

Figure 10:
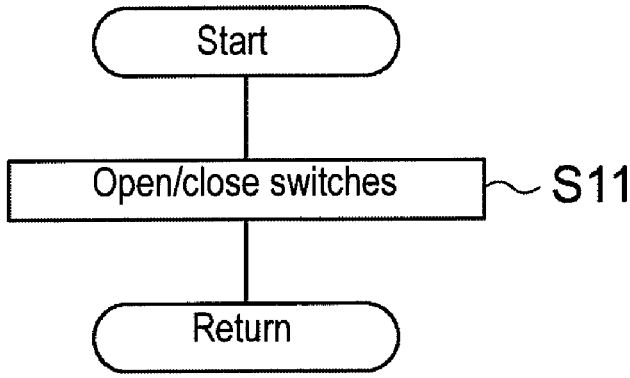
FIG. 10 is a flowchart when the APC operation is not carried out in the image forming apparatus according to the one exemplary embodiment of the present invention.

FIG. 10 is a flowchart when the APC operation is not carried out.

When the APC operation is not carried out, the control section 314 carries out such a switch opening and closing operation so as to close the switch $SW1_y$, close the switch $SW2_y$ and open the switch SW3 (Step S11).

Therefore, since the current obtained by adding the difference current $Idiff_y$ to the reference current $Iref1_y$ will be supplied to the non-inverting (+) input terminal of the difference detection circuit 221, the current value becomes the comparison current Ibias that does not vary depending on either the case where a Y-color latent image is formed or the case where an M-color latent image is formed.

What is claimed is:

1. An exposure device comprising:

a light emitting element;

a reference current generating unit that generates a reference current corresponding to a target value of a light amount of the light emitting element, for each image of respective colors formed by exposure using the light emitting element;

a photoelectric current generating unit that generates a photoelectric current in response to the light amount of the light emitting element;

a driving unit that drives the light emitting element by providing a drive voltage from a drive voltage holding unit to the light emitting element;

a first controller that controls the driving unit so that the photoelectric current becomes equal to the reference current;

a comparison current generating unit that generates a predetermined comparison current; and a difference current generating unit that generates a difference current for each color, having a value corresponding to a difference between the reference current of each color and the predetermined comparison current, wherein the first controller compares a value obtained by adding the difference current of each color to the photoelectric current with the predetermined comparison current to provide the drive voltage to the drive voltage holding unit such that the photoelectric current becomes equal to the reference current.

2. The exposure device according to claim 1, wherein the first controller compares a value obtained by adding the difference current of each color to the reference current of each color with the predetermined comparison current when the first controller does not control the driving unit so that the photoelectric current becomes equal to the reference current.

3. The exposure device according to claim 1, wherein the predetermined comparison current is the same for each color.

4. An image forming apparatus comprising:

a photosensitive body;

an exposure device that forms a latent image on the photosensitive body; and a developing device that develops the latent image, wherein the exposure device comprises:

a light emitting element, a reference current generating unit that generates a reference current corresponding to a target value of a light amount of the light emitting element, for each image of respective colors formed by exposure using the light emitting element, a photoelectric current generating unit that generates a photoelectric current in response to the light amount of the light emitting element, a driving unit that drives the light emitting element by providing a drive voltage from a drive voltage holding unit to the light emitting element, a first controller that controls the driving unit so that the photoelectric current becomes equal to the reference current, a comparison current generating unit that generates a predetermined comparison current, and a difference current generating unit that generates a difference current, of each color, having a value corresponding to a difference between the reference current of each color and the predetermined comparison current, and the first controller compares a value obtained by adding the difference current of each color to the photoelectric current with the predetermined comparison current to provide the drive voltage to the drive voltage holding unit such that the photoelectric current becomes equal to the reference current.

5. The image forming apparatus according to claim 4, wherein the predetermined comparison current is the same for each color.

6. A computer-readable medium storing a program that causes a computer to execute an exposure control process, wherein an exposure device comprises:

a light emitting element, a reference current generating unit that generates a reference current corresponding to a target value of a light amount of the light emitting element, for each image of respective colors formed by exposure using the light emitting element, a photoelectric current generating unit that generates a photoelectric current in response to the light amount of the light emitting element, a driving unit that drives the light emitting element by providing a drive voltage form a drive voltage holding unit to the light emitting element, a first controller that controls the driving unit so that the photoelectric current becomes equal to the reference current, a comparison current generating unit that generates a predetermined comparison current, and a difference current generating unit that generates a difference current, of each color, having a value corresponding to a difference between the reference current of each color and the predetermined comparison current, the exposure control process comprising:

controlling the exposure device so as to cause the driving unit to compare a value obtained by adding the difference current of each color to the photoelectric current with the predetermined comparison current to provide the drive voltage to the drive voltage holding unit such that the photoelectric current becomes the reference current.

7. The computer readable medium storing a program according to claim 6, wherein the predetermined comparison current is the same for each color.

* * * * *